US007546902B2

(12) United States Patent
Schwertner

(10) Patent No.: US 7,546,902 B2
(45) Date of Patent: Jun. 16, 2009

(54) PERSONNEL LIFT APPARATUS

(76) Inventor: Larry Victor Schwertner, 2102 CR 399, Ballinger, TX (US) 76821

( * ) Notice: Subject to any disclaimer, the term of this patent is extended or adjusted under 35 U.S.C. 154(b) by 311 days.

(21) Appl. No.: 11/593,353

(22) Filed: Nov. 6, 2006

(65) Prior Publication Data

US 2007/0107990 A1 May 17, 2007

Related U.S. Application Data

(60) Provisional application No. 60/734,526, filed on Nov. 7, 2005.

(51) Int. Cl.
*B66B 9/16* (2006.01)
*B66B 9/06* (2006.01)
*B66F 11/00* (2006.01)

(52) U.S. Cl. ..... 187/241; 187/245; 187/406; 182/69.6; 182/103; 182/148; 414/630; 414/631

(58) Field of Classification Search ..... 248/297.21; 187/241, 245, 276; 182/69.6, 37, 102–103, 182/148; 104/124–127; 414/630–631
See application file for complete search history.

(56) References Cited

U.S. PATENT DOCUMENTS 292,265 A * 1/1884 Stoddard ..... 182/37
2,394,148 A * 2/1946 Campbell ..... 182/103
2,714,434 A * 8/1955 Peterson ..... 477/170
2,950,948 A * 8/1960 Hardigan et al. ..... 187/202
3,115,211 A * 12/1963 Ostrander, Jr. ..... 182/103
3,428,145 A * 2/1969 Lyon ..... 182/103
3,614,994 A * 10/1971 Goodrum ..... 187/406
3,672,471 A * 6/1972 Badding ..... 187/259
4,026,387 A * 5/1977 Abreu ..... 414/541
4,183,423 A * 1/1980 Lewis ..... 182/103
4,324,317 A * 4/1982 Winkelblech ..... 187/267
5,273,132 A * 12/1993 Sasaki et al. ..... 182/148
6,244,381 B1 * 6/2001 Ruble ..... 182/103
6,371,449 B1 * 4/2002 Chamberlain ..... 254/387
6,640,934 B1 * 11/2003 Edwards ..... 187/239
7,004,288 B2 * 2/2006 Araki et al. ..... 182/103

* cited by examiner

*Primary Examiner*—Peter M Cuomo
*Assistant Examiner*—Stefan Kruer
(74) *Attorney, Agent, or Firm*—Raymond M. Galasso; Galasso & Associates, L.P.

(57) ABSTRACT

Accordingly, embodiments of the inventive disclosures made herein comprise a personnel lift apparatus for raising or lowering a standing person between two or more elevations or from a base elevation to a raised elevation. A moveable lift platform rides within a track provided on a pair of substantially upright side rails. The platform is connected by a flexible metallic cable to an electrically operated winch. The personnel lift eliminates steps and ladders on recreational items or any equipment requiring climbing.

14 Claims, 6 Drawing Sheets

PERSONNEL LIFT APPARATUS

CROSS REFERENCE TO RELATED APPLICATIONS

This application claims priority to co-pending U.S. Provisional Patent Application having Ser. No. 60/734,526 filed Nov. 7, 2005 entitled "Personnel Lift" having a common applicant herewith.

FIELD OF THE DISCLOSURE

The disclosures made herein relate generally to load bearing lift apparatus, and more particularly to electrically driven lift apparatus for raising or lowering a standing person between two or more elevations, or between a base plane and a raised platform.

BACKGROUND

In performing assigned duties workers often need to move between a base level and one or more elevated platforms. For example, this can be the case on say large earth moving or earth transport equipment or on large machinery used in farming operations. In such cases the equipment is normally provided with a fixed rung ladder or with steps that are climbed by the worker or person to move between various elevations. Ladders of both the fixed and portable types are very common, from ladders to reach an elevated platform of a recreational item such as a deer blind to ladders in chemical and manufacturing plants to move between platforms and walkways at various elevations, or to climb to the top of equipment or towers. Additional examples include a ladder to enable a hunter to reach an elevated platform in a deer blind, or to access elevated positions to perform maintenance work on the outside siding of a home or perform roof repairs.

Workers and others climb and descend ladders frequently in the completion of the tasks of their trade, often while carrying tools and other materials. However, repeatedly climbing and descending ladders throughout the work day can be tiring, even more so for people having bad knees or other temporary or permanent physical handicaps and injuries.

Therefore, a personnel lift apparatus having a movable platform configured to raise or lower a person standing on the lift platform between two or more elevations, a personnel lift that makes repetitive moving between elevations less stressful to the human body and reduces the required effort, a personnel lift that eliminates the need to manually climb ladders, a personnel lift that in certain embodiments can be retrofitted onto a fixed or portable ladder, such a personnel lift apparatus would be useful and novel.

SUMMARY OF THE DISCLOSURE

Accordingly, embodiments of the inventive disclosures made herein comprise a personnel lift apparatus for raising or lowering a standing person between two or more elevations, with embodiments for fixed ladders as well as portable embodiments.

In a various embodiments of the inventive disclosures made herein a personnel lift apparatus for raising or lowering a standing person between two or more elevations generally comprises two elongated upright substantially parallel distally spaced rails. Each rail has a track substantially along the length of the rail. The top end of each of the rails is either supportively resting against, or in cases of fixed ladders secured to, an elevated member such as a platform, tree branch or tree trunk, platform of a deer blind, sidewall of a home, or other elevated supportive member. The plate or other support member, which may be a platform of a recreational item such as a deer blind, a raised walkway in a manufacturing-facility, a leg of a ladder over which the personnel lift is installed or any other number of raised platform-like entities to which a person may need to occasionally climb to or descend from. The track on each rail provides a supportive and retentive guide track for the movable load bearing platform. The movable load bearing lift platform for raising or lowering a person in a standing position on the personnel lift apparatus is provided with a substantially horizontal platform floor sized to supportively receive a standing person onto the platform floor. The movable platform has a rigid back wall secured to the back edge of the platform floor. The back wall is substantially perpendicular to the platform floor and extending above the platform floor so as to guidably retain feet of the standing person on the platform to prevent a foot from sliding over the back side of the platform. Sidewalls are secured to opposing side edges of the platform floor and are secured along a rear portion to opposing side edges of the rigid back wall. The sidewalls together with the back wall form a rigid frame for the structural support of the platform floor. Additionally, the sidewalls guidably retain the feet of the standing person on the platform floor. Each sidewall of the moveable lift platform is provided with a flange, and each flange has two distally spaced holes therethrough. The holes in the flanges are positioned near opposing top and bottom portions of the flange. The flanges are used to secure the movable platform to a roller bracket assembly that rides upon or within the track of each rail. The moveable lift platform includes a pair of roller bracket assemblies secured to opposing side of the lift platform. Each roller bracket assembly comprises an elongated roller bracket frame having two holes for receiving an axle and two holes for receiving an elongated threaded bolt therethrough. The axle holes are located near opposing ends of the roller bracket frame. The axle holes extend through opposing sidewalls of the roller bracket frame. Each roller bracket includes two axles, each axle received into the axle hole discussed above, each axle is sized to extend outwards beyond the sidewalls of the roller bracket frame to have sufficient length to rollably engage a roller wheel at each side of the roller bracket. Each roller bracket includes two pairs of roller wheels, each pair on opposing end of the roller bracket, each roller wheel having a bearing for receiving the axle therethrough, each roller wheel rollably secured to opposing ends of the axle, wherein the roller bracket frame and roller wheels are rollably, moveably received into the track of the rails. A pair of elongated threaded bolts secures the roller bracket to the flange of the lift platform. Each bolt is received into the bolt holes of the flange with each bolt having a threaded portion extending outwards beyond the top face of the roller bracket and continuing to extend outwards beyond the front face of the rail and reaching through the holes in the flanges where they are secured to the flanges by nuts and lock washers, or other, suitable means. This invention is not limited to the use of elongated bolts to secure the roller brackets to the flanges of the lift platform, other means of securing the roller brackets to the lift platforms may be used as would be know to one skilled in the art. With moveable platform secured to the roller bracket as above, the moveable load bearing platform is rollably, supportively and moveably secured to the rails by the roller bracket assemblies, wherein the load bearing platform is free to move along and guided by the track of the rails. The personnel lift platform is driven by an electrical motor drive to accomplish the raising and lowering of the movable platform. The cable sheave and motor may be mounted to the rails of the personnel lift (particularly advantageous in the case of a portable personnel lift), or in the case of a fixed ladder the motor and sheave may be mounted to the underside of an overhead platform. The motor driven means comprises a reversible electric drive motor having an output shaft connected to a gear reducer which transforms the high speed low torque of the motor to low speed high torque needed to raise the personnel lift platform. The output shaft of the gear reducer drives a cable spool sheave. One end of a metallic cable such as steel wire rope cable is connected to and windably received upon the cable spool sheave. The remaining portion of the cable feeds through a pulley located near the top end of the rails and mounted below the elevated platform. From the pulley the cable proceeds down behind the rails to fasten to the cable termination mount secured to the back side of the moveable lift platform. The motor drive winds or unwinds the cable from the spool to raise or lower the moveable platform. The weight of the lift platform and load thereon is transmitted through the cable as tension to cancel the downward force of gravity and support the platform at an elevation along the rails. A substantially upright hand hold bar or opposing hand hold bars (one each side of the platform) are provided having a lower portion secured to one flange of the lift platform. The hand holds providing hand graspable support to a person riding the lift platform so as to stabilize the person on the lift. Mounted to one of the hand hold bar is an electrical drive motor control means, the control means operable by the hand of the person riding the lift platform. The control means has lift platform raise, lower and stop positions for commanding rotation of the motor driven means. A safety belt or strap is provides to prevent the person using the lift from falling off the platform while using the personnel lift. One end of the safety strap is secured to one of the hand hold bars; the opposing end of the safety strap is equipped with a latching device for removably locking into the receptacle on the; opposing hand hold bar. The receptacle is electrically operable to disable operation of the drive motor when the safety belt is not latched in the receptacle and to enable the drive motor control means when the safety belt is latched into the receptacle.

For safety, a brake means engages to prevent the motor driven means from rotating under the weight of the load on the movable platform in the event of a power failure. The brake means releases during commanded operation of the motor driven means then re-engages after the command completes. The brake means is of a fail-safe type, energize to release brake type.

In a second embodiment of the inventive disclosures made herein, the personnel lift apparatus as described in general above is modified such that the track of each rail comprises a cavity along the length of the rail and a slot extending through a front face of the rail, the slot joining with the cavity. The cavity and slot provide a supportive and retentive guide track for the movable load bearing platform. The roller bracket frame and roller wheels are rollably, moveably and retentively received into the above cavity of the rail. The elongated threaded bolts of the roller bracket extend outwards through the slot of the rail and extend through the holes of the flanges of the movable lift platform where they are secured to the flanges, thereby structurally mounting the movable lift platform to the roller bracket assembly to the moveable lift platform.

In a third embodiment of the inventive disclosures made herein, the personnel lift apparatus of the second embodiment is modified to have each rail secured to opposing substantially upright legs of a ladder wherein the personnel lift eliminates the need for a person to climb the ladder.

In a fourth embodiment of the inventive disclosures made herein, the personnel lift apparatus of the third embodiment is modified such that the drive motor control means comprises an electrical rocker switch secured to the hand hold bar of the movable platform. The rocker switch positioned to be easily operated by the hand of the moveable platform rider. The rocker switch provides raise, lower and stop positions and the rocker switch is spring loaded to automatically return to the stop position when released, thereby stopping platform movement.

It is an objective of the inventive disclosures made herein to provide an electric personnel lift which is not anticipated, rendered obvious, suggested, or implied by the known prior art.

It is another objective of the present inventive disclosures to provide a new personnel lift that makes repetitive moving between elevations less stressful to the human body and reduces the required effort by eliminating the need to manually climb ladders.

It is another objective of the present inventive disclosures to provide a new personnel lift that in various embodiments can be retrofitted onto a fixed or portable ladder.

It is another objective of the present inventive disclosures to provide a new personnel lift which can be operated in the absence of or unavailability of utility electric power supply, for instance at remote locations in a field on farm equipment, as well as in remote wooded areas by the use of one or more storage batteries to supply power.

It is another objective of the present inventive disclosures to provide a new electric personnel lift which has improved safety features due to a fail-safe braking means.

It is another objective of the present inventive disclosures to provide a new electric personnel lift which has improved safety features due to a safety strap which must be extended around the back of the rider on the platform and locked into a receptacle on the hand hold bar to permissively enable the drive motor to operate.

These and other objects of the invention made herein will become readily apparent upon further review of the following specification and associated drawings.

BRIEF DESCRIPTION OF THE DRAWINGS

The drawings show a form of the invention that is presently preferred; however, the invention is not limited to the precise arrangement shown in the drawings.

DETAILED DESCRIPTION OF THE DRAWINGS

In preparation for explaining the details of the present inventive disclosure, it is to be understood by the reader that the invention is not limited to the presented details of the construction, materials and embodiments as illustrated in the accompanying drawings, as the invention concepts are clearly capable of other embodiments and of being practiced and realized in various ways by applying the disclosure presented herein.

Figure 1:
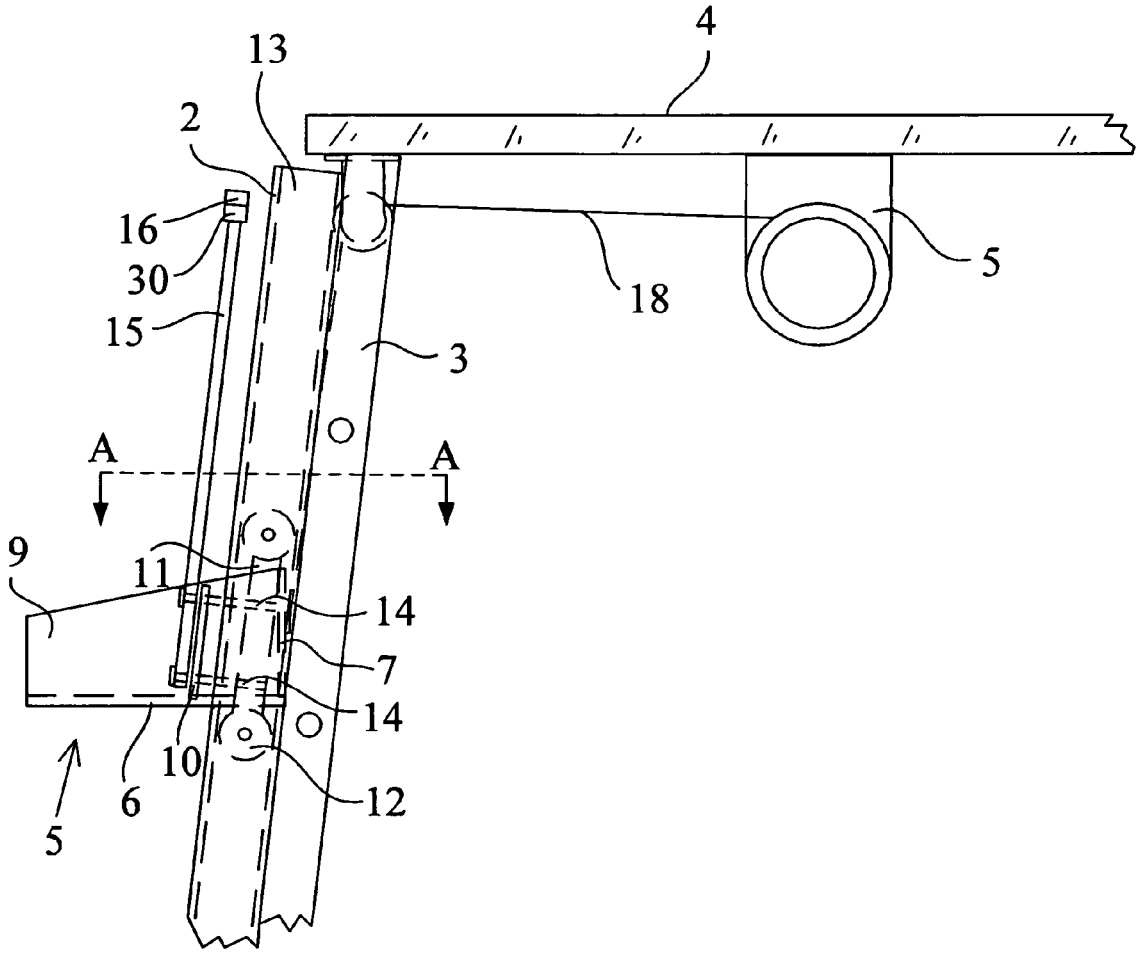
FIG. 1 depicts a side view of one embodiment of the personnel lift in accordance with the inventive disclosures herein.
Figure 5:
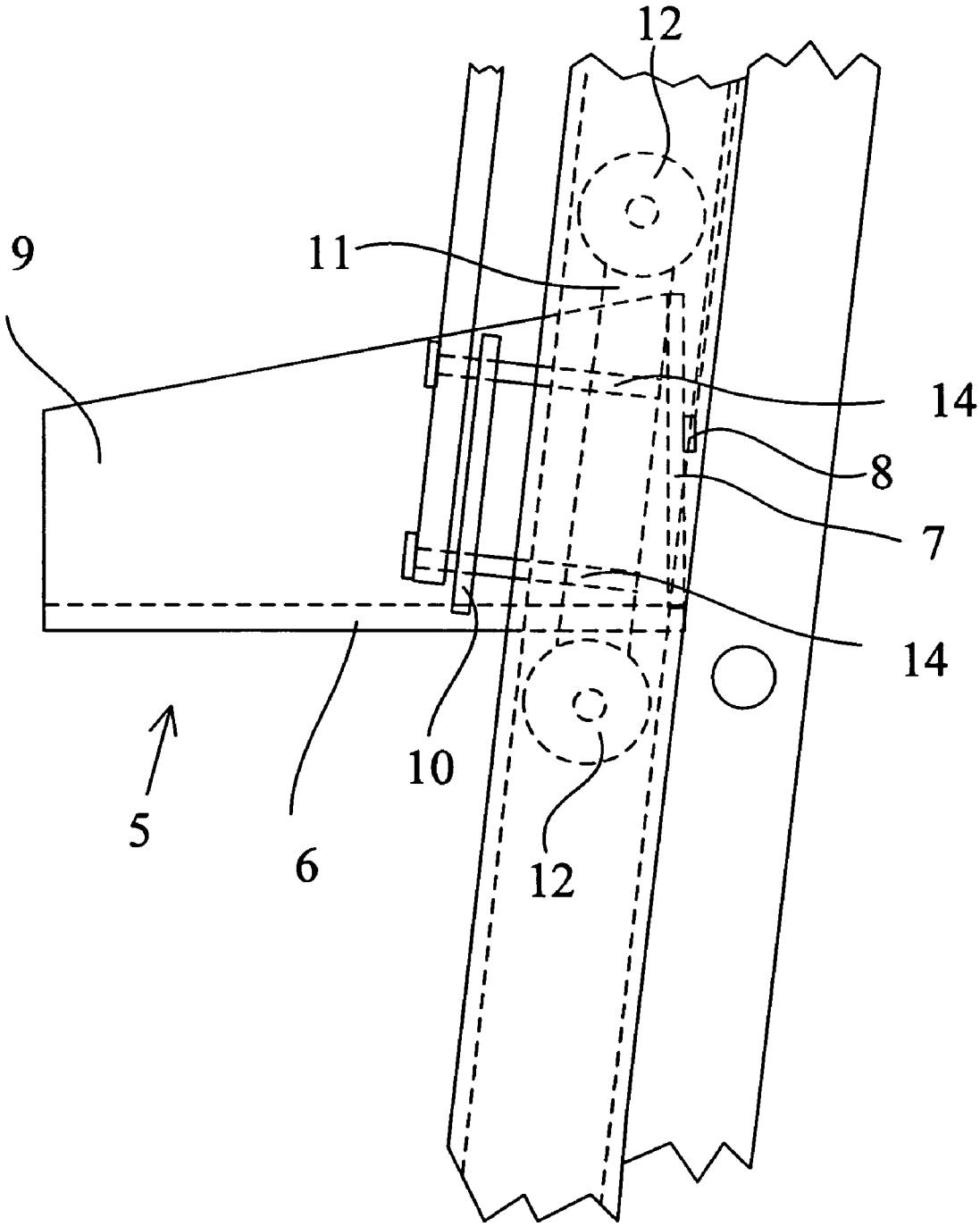
FIG. 5 depicts an enlargement of the lift platform and roller assemblies of the personnel lift of FIG. 1 or FIG. 1A.

Turning now to FIG. 1 together with FIG. 5

FIG. 1 depicts a right side view of one embodiment of the personnel lift in accordance with the inventive disclosures herein. FIG. 5 depicts a right side view enlargement of the lift platform and roller assembly of the personnel lift of FIG. 1. One of two elongated upright substantially parallel distally spaced rails 2 is depicted as attached to a front face of fixed ladder 3, the fixed ladder 3 and spaced rails of the personnel lift reaching from a base elevation to the elevated platform 4. An electrically motor driven means of raising and lowering the movable platform, in the depicted case an electric winch 5 is secured to a bottom surface of the elevated platform 4. The movable load bearing lift platform 5 for raising or lowering a person in a standing position on the personnel lift apparatus has a substantially horizontal platform floor 6 sized for supportively receiving a standing person onto the platform floor. The rigid back wall 7 of the platform has a cable clamp 8 secured to the back wall in a mid portion of the back wall. The back wall 7 secured to a back edge of the platform floor 6, the back wall extending above the platform floor so as to guidably retain feet of the standing person on the platform. A pair of sidewalls 9, of which only one is illustrated, are secured to opposing side edges of the platform floor 6. The sidewalls are secured along a rear portion to opposing side edges of the rigid back wall 7 such that the sidewalls and back wall forming a rigid flame for providing structural support to the platform floor while the sidewalls guidably retain the feet of the standing person on the platform floor. A pair of flanges 10 each has two distally spaced holes therethrough, the holes positioned near opposing top and bottom portions of the flange 10. Each flange secured to an outside face of the opposing sidewalls 9, wherein each sidewall has only one flange secured thereto.

A pair of roller bracket assemblies, one per rail, comprise an elongated roller bracket frame 11 having two pairs of roller wheels 12, each pair rollably secured to opposing ends of the roller bracket frame 11 such that the roller bracket frame and roller wheels are free to move along the track of the rail 2. Each rail has a cavity 13 substantially along length of the rail and a slot extending through a front face of the rail, the slot joining with the cavity, the cavity and slot providing a supportive and retentive guide track for a movable load bearing platform.

Each side of the personnel lift platform has a substantially upright hand hold bar 15 having a lower portion secured to one flange 10 of the lift platform, the hand hold 15 providing hand support to a person riding the lift platform so as to stabilize the rider on the platform. An electrical rocker switch 16 is secured at the top of one of the hand hold bars 15, preferably the right hand hold bar. The rocker switch is positioned to be easily operated by the hand of the moveable platform rider. The rocker switch has raise, lower and stop positions on the rocker switch and is of the spring loaded type to automatically return to the stop position when finger grasp is released. Mounted to the hand hold bar 15 below the rocker switch 16 is a belt receptable 30 for latchably receiving a releasable end of a safety belt therein. The opposing end of the safety belt is secured to the hand hold bar 15 on the opposing side of the lift platform from the side having the rocker switch 16. The safety belt is adapted to be secured around the back of a person riding the platform 6 so as to prevent the rider from falling off the platform 6. The winch 5 and rocker switch 16 are disabled until the safety belt is secured into the belt receptacle 30, preventing the personnel lift from being operated until the safety strap is secured.

The wire rope cable 18 from the cable spool on the winch 5 routes over a cable pulley 17 secured to the underside of the elevated platform 4. The cable from the pulley routes down between the rails 2 to mount to the rigid back wall 7 of the movable lift platform 5 by cable termination mount 8, wherein the winch is operated by the rocker switch to windably retract the cable and raise the platform, or to unwind the cable and lower the platform.

Figure 1A:
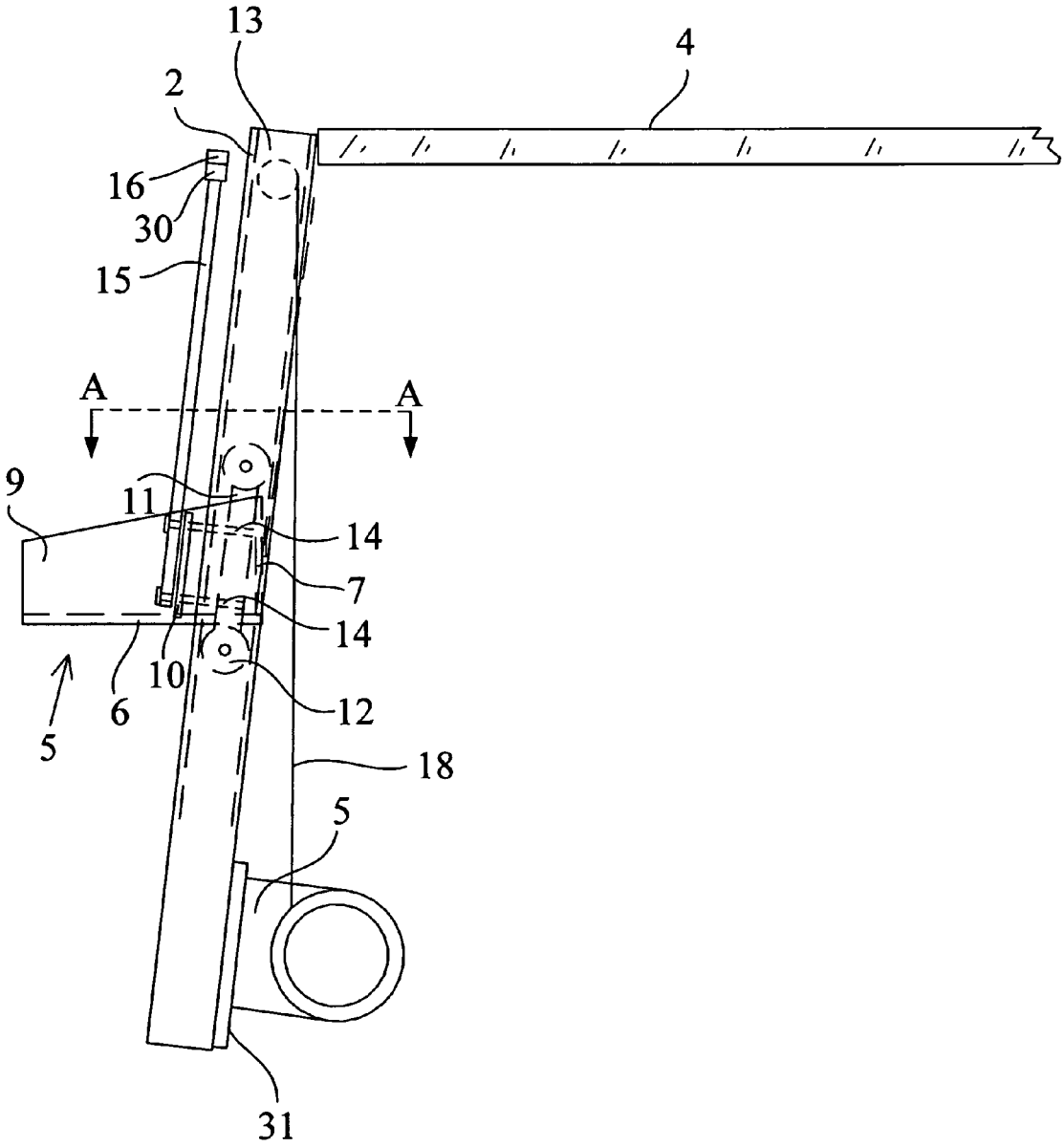
FIG. 1A depicts a side view of an embodiment of a portable personnel lift in accordance with the inventive disclosures herein

Turning now to FIG. 1A together with FIG. 5 presenting a variation of the embodiment presented in FIG. 1 being adapted for use as a portable personnel lift.

FIG. 1A depicts a right side view of the portable embodiment of the personnel lift in accordance with the inventive disclosures herein.

One of two elongated upright substantially parallel distally spaced rails 2 is depicted, the spaced rails of the personnel lift reaching from a base elevation to the elevated platform, for example a deer blind. An electrically motor driven means of raising and lowering the movable platform, in the depicted case an electric winch 5 is secured to a cross member or plate 31 which mounts and bridges between the rails 2. The movable load bearing lift platform 5 for raising or lowering a person in a standing position on the personnel lift apparatus has a substantially horizontal platform floor 6 sized for supportively receiving a standing person onto the platform floor. The rigid back wall 7 of the platform has a cable clamp 8 secured to the back wall in a mid portion of the back wall. The back wall 7 secured to a back edge of the platform floor 6, the back wall extending above the platform floor so as to guidably retain feet of the standing person on the platform. A pair of sidewalls 9, of which only one is illustrated, are secured to opposing side edges of the platform floor 6. The sidewalls are secured along a rear portion to opposing side edges of the rigid back wall 7 such that the sidewalls and back wall forming a rigid frame for providing structural support to the platform floor while the sidewalls guidably retain the feet of the standing person on the platform floor. A pair of flanges 10 each has two distally spaced holes therethrough, the holes positioned near opposing top and bottom portions of the flange 10. Each flange secured to an outside face of the opposing sidewalls 9, wherein each sidewall has only one flange secured thereto.

A pair of roller bracket assemblies, one per rail, comprise an elongated roller bracket frame 11 having two pairs of roller wheels 12, each pair rollably secured to opposing ends of the roller bracket frame 11 such that the roller bracket frame and roller wheels are free to move along the track of the rail 2. Each rail has a cavity 13 substantially along length of the rail and a slot extending through a front face of the rail, the slot joining with the cavity, the cavity and slot providing a supportive and retentive guide track for a movable load bearing platform. In certain embodiments the rails 2 may by attached to the legs 3 of a ladder as illustrated in FIG. 1 and FIG. 5. In other embodiments, such as the illustrated embodiment in FIG 1A, the personnel lift may be used alone to raise and lower a person on the platform 5 without having or securing the rails 2 to a ladder.

Each side of the personnel lift platform has a substantially upright hand hold bar 15 having a lower portion secured to one flange 10 of the lift platform, the hand hold 15 providing hand support to a person riding the lift platform so as to stabilize the rider on the platform. An electrical rocker switch 16 is secured at the top of one of the hand hold bars 15, preferably the right hand hold bar. The rocker switch is positioned to be easily operated by the hand of the moveable platform rider. The rocker switch has raise, lower and stop positions on the rocker switch and is of the spring loaded type to automatically return to the stop position when finger grasp is released. Mounted to the hand hold bar 15 below the rocker switch 16 is a belt receptable 30 for latchably receiving a releasable end of a safety belt therein. The opposing end of the safety belt is secured to the hand hold bar 15 on the opposing side of the lift platform from the side having the rocker switch 16. The safety belt is adapted to be secured around the back of a person riding the platform 6 so as to prevent the rider from falling off the platform 6. The winch 5 and rocker switch 16 are disabled until the safety belt is secured into the belt receptacle 30, preventing the personnel lift from being operated until the safety strap is secured.

The wire rope cable 18 from the cable spool on the winch 5 routes from the winch 5 up between the rails 2 to a pulley 32 secured to an upper portion of the personnel lift between the rails 13. The cable from the pulley 32 routes down between the rails 2 to mount to the rigid back wall 7 of the movable lift platform 5 by cable termination mount 8, wherein the winch is operated by the rocker switch to windably retract the cable and raise the platform, or to unwind the cable and lower the platform.

Figure 2:
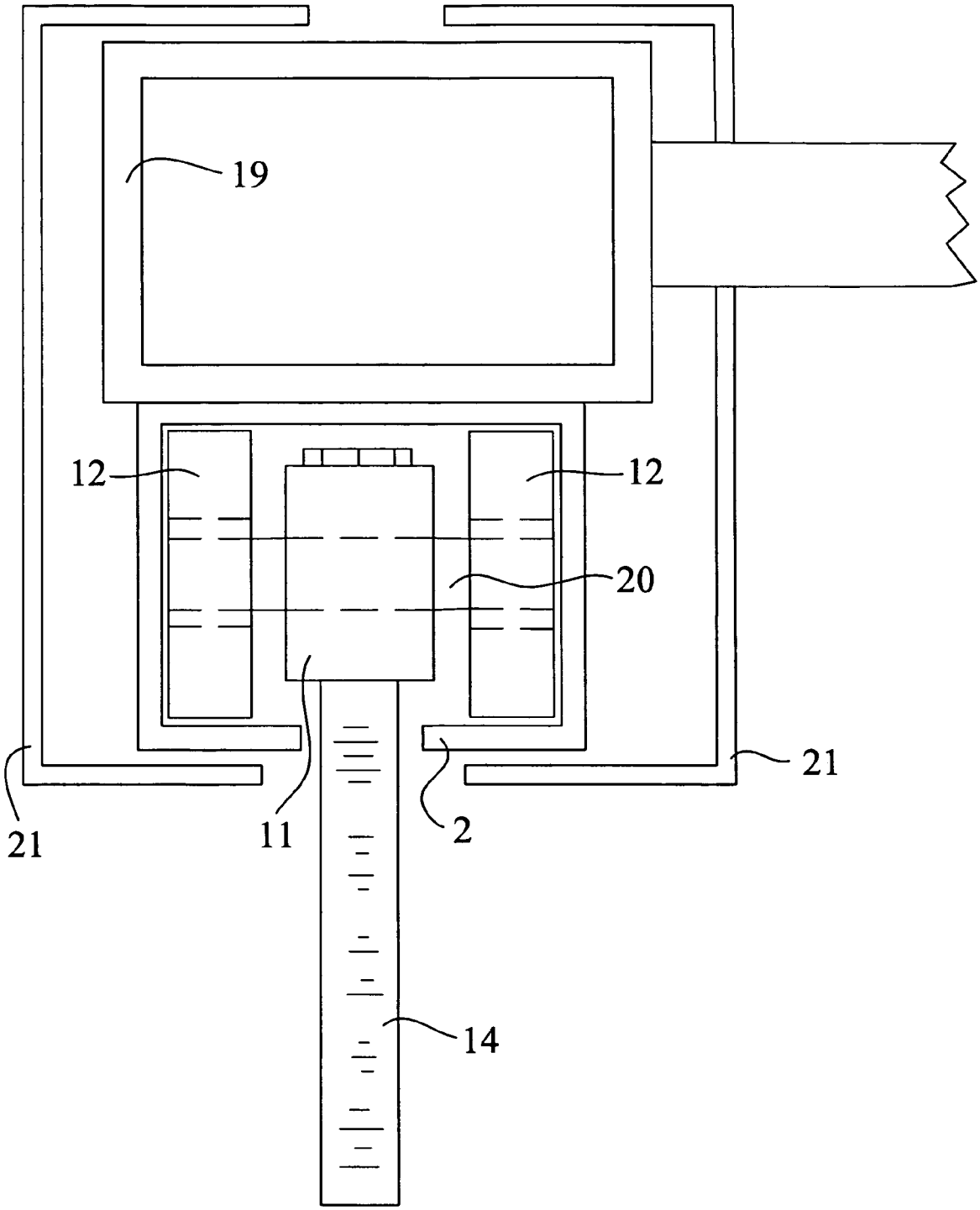
FIG. 2 depicts a top sectional view along A-A of FIG. 1 or FIG. 1A of the personnel lift in accordance with the inventive disclosures herein showing the roller wheels and roller bracket riding within the rails and the personnel lift rails secured to a face of a fixed or portable ladder.

FIG. 2 depicts a top sectional view along A-A of FIG. 1 or FIG. 1A of the personnel lift in accordance with the inventive disclosures herein showing the roller wheels 12 of the roller bracket 11 riding moveably and retentively riding within the substantially upright side rail 2. In this embodiment, the side rail is secured to the front face of the leg 19 of an existing fixed ladder by straps 21, wherein the personnel lift apparatus eliminates the need to climb steps or the ladder to reach an elevated platform. Roller wheels 12 are free to roll on axle 20. Axle 20 rollably secures the roller wheels 12 to the roller bracket frame 11.

Figure 3:
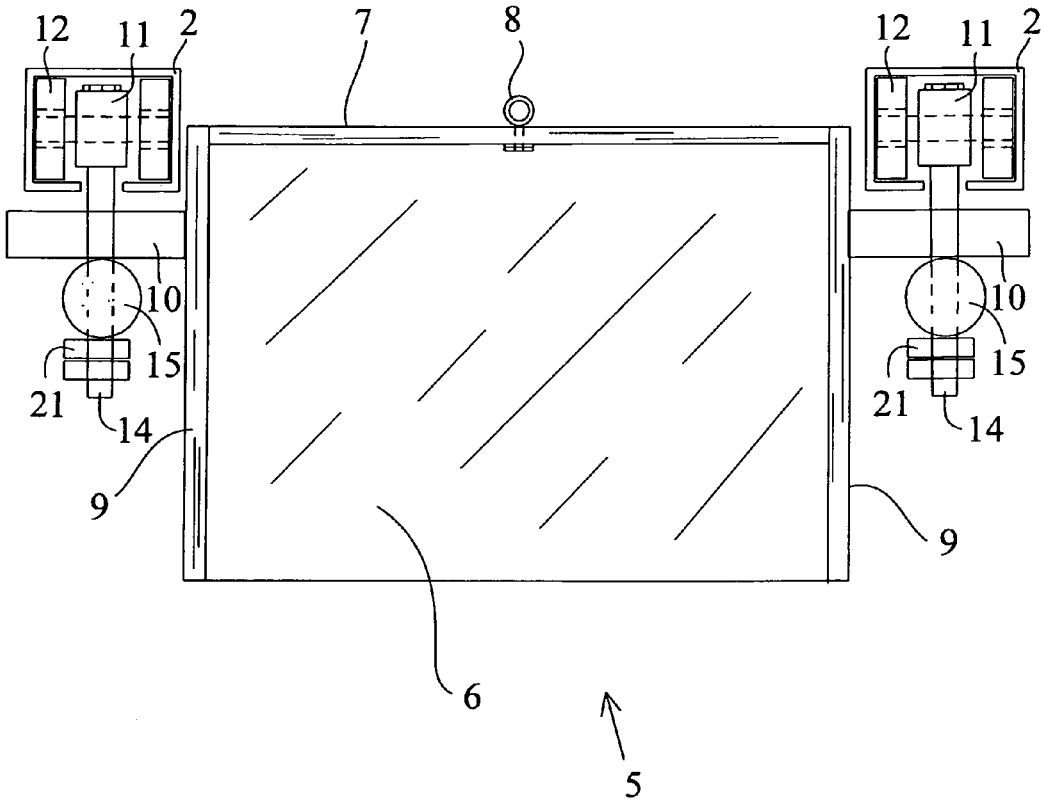
FIG. 3 depicts a top sectional view along A-A of FIG. 1 or FIG. 1A of the personnel lift in accordance with the inventive disclosures herein.

FIG. 3 depicts a top sectional view along A-A of FIG. 1 or FIG. 1A of the personnel lift in accordance with the inventive disclosures herein. In this view both side rails are shown together with the movable platform of the personnel lift. Roller wheels 12 on roller bracket frames 11 are free to roll while retained within the cavity of the side rails 2. Two bolts 14 extend outwards from the roller bracket frame 11 and through holes in the flanges 10 of the moveable personnel lift platform 5. Threaded nuts 21 secure the flanges 10 and lift platform 5 to the roller bracket frames 11. The rigid back wall 7 of the lift platform is provided with a cable termination mount 8 to which the steel wire rope cable of the winch is secured. The flanges 10 are secured to outside surfaces of the platform side walls 9. The substantially horizontal platform floor 6 is secured to the rigid back wall 7 and the side walls 9. The substantially upright hand hold bar 15 has a lower portion secured to the right flange 10 of the lift platform by the bolts 14 securing the flange 10 to the roller bracket frame.

Figure 4:
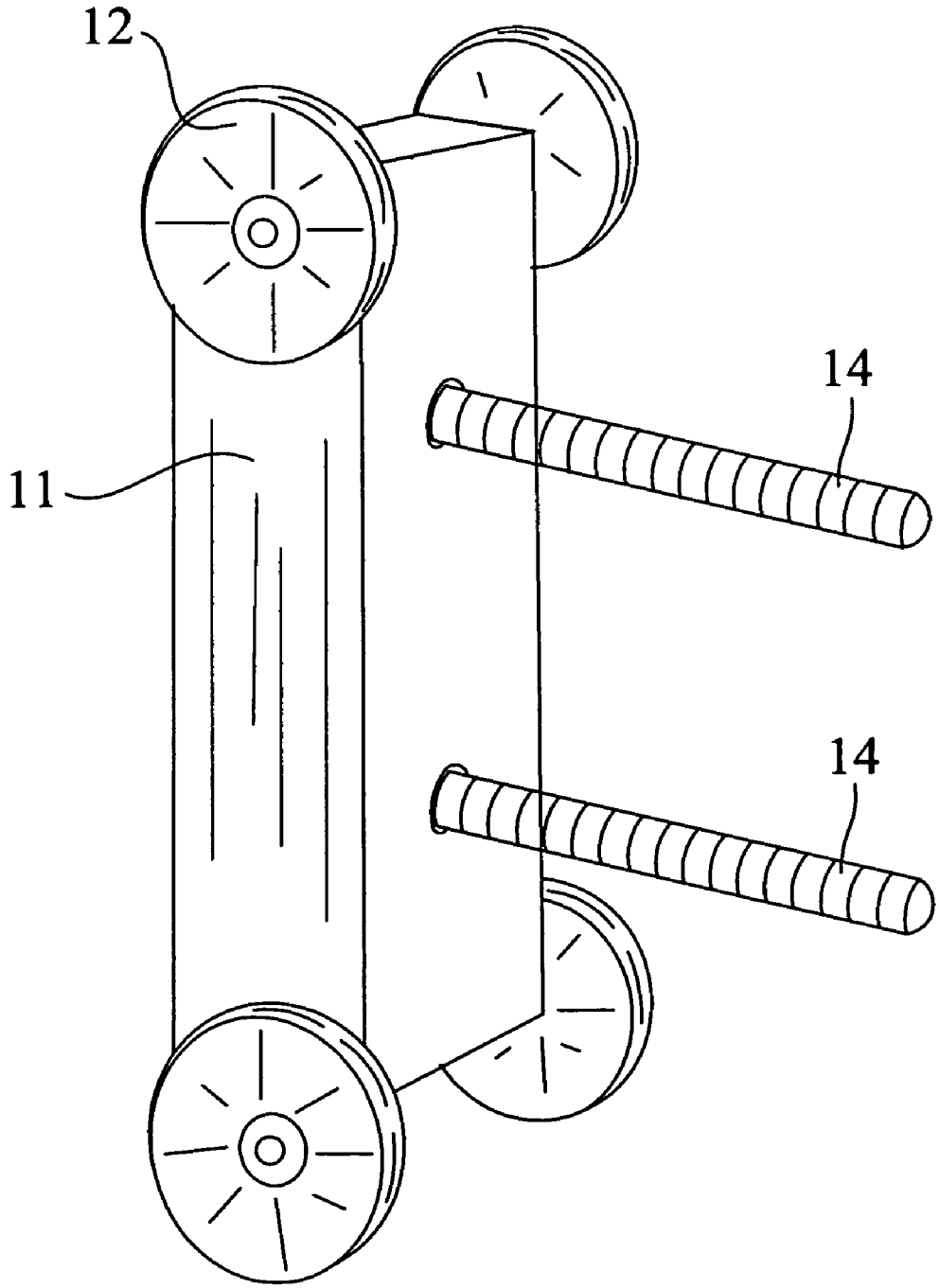
FIG. 4 depicts a perspective view of the roller bracket and roller wheels of one embodiment of the personnel lift in accordance with the inventive disclosures herein.

FIG. 4 depicts a perspective view of the roller bracket and roller wheels of one embodiment of the personnel lift in accordance with the inventive disclosures herein. The roller bracket and wheels are depicted outside of the rail. Roller bracket 11 has two pairs of roller wheels, one pair of roller wheels 12 is rollably secured near opposing ends of the roller bracket 11. Thread bolts 14 extend outwards from the roller bracket 11 to eventually engage with the flanges of the lift platform.

The discussed construction, illustrations and sequence of operation is for one embodiment of the invention, but is in no way limiting to other embodiments. The operating modes may be changed and enhanced without deviating from the intention of this inventive disclosure.

In the preceding detailed description, reference has been made to the accompanying drawings that form a part hereof, and in which are shown by way of illustration specific embodiments in which the invention may be practiced. These embodiments and certain variants thereof have been described in sufficient detail to enable those skilled in the art to practice the invention. It is to be understood that other suitable embodiments may be utilized and that logical, material, electrical and mechanical changes may be made without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications and equivalents, as can be reasonably included within the spirit and scope of the appended claims.

What is claimed is:

1. A personnel lift apparatus for raising or lowering a standing person between two or more elevations comprising:

two elongated upright substantially parallel distally spaced rails, each rail having a track along length of the rail, a top end of the rails secured to an elevated platform member, the rail providing a supportive and retentive guide track for a movable load bearing platform;

the movable load bearing lift platform for raising or lowering a person in a standing position on the personnel lift apparatus, the movable lift platform comprising:

a substantially horizontal platform floor sized for supportively receiving a standing person onto the platform floor;

a rigid back wall having a hole for receiving a cable clamp in a mid portion of the back wall, the back wall secured to a back edge of the platform floor, the wall substantially perpendicular to the platform floor, the back wall extending above the platform floor so as to guidably retain feet of the standing person on the platform;

a pair of sidewalls, each secured to opposing side edges of the platform floor, the sidewalls secured along a rear portion to opposing side edges of the rigid back wall, the sidewalls and back wall forming a rigid frame for structural support to the platform floor, the sidewalls guidably retaining the feet of the standing person on the platform floor; and a pair of flanges having two distally spaced holes therethrough, the holes positioned near opposing top and bottom portions of the flange, the flanges distally spaced across the platform, each flange uniquely secured to an outside face of the opposing sidewalls, wherein each sidewall has only one flange secured thereto;

a pair of roller bracket assemblies, each roller bracket assembly comprising:

an elongated roller bracket frame having two holes for receiving an axle and two holes for receiving an elongated threaded bolt therethrough, the axle holes proximate opposing end portions of the roller bracket frame, the axle holes extending through opposing sidewalls of the roller bracket frame, the bolt holes distally spaced along and extending through a top and bottom face of the roller bracket frame, the holes in each roller bracket positioned to align with the distally spaced holes in one flange;

two axles, each axle received into the axle hole, each axle sized to extend outwards beyond the sidewalls of the roller bracket frame;

two pairs of roller wheels, each roller wheel having a bearing for receiving the axle therethrough, each roller wheel rollably secured to opposing ends of the axle, wherein the roller bracket frame and roller wheels are rollably and moveably received onto the track of the rail; and a pair of elongated threaded bolts, each bolt received into the bolt holes of the flange, each bolt having a threaded portion extending outwards beyond the top face of the roller bracket, extending outwards beyond the front face of the rail and extending through the holes of the flanges and secured to the flanges, wherein the moveable load bearing platform is rollably, supportively and moveably secured to the rails by the roller bracket assemblies, wherein the load bearing platform is free to move along and guided by the track of the rails;

an electrically motor driven means of raising and lowering the movable platform, the motor driven means comprising:

a reversible electric drive motor having an output shaft;

a flexible metallic cable having two ends, a first end secured to the back wall of the lift platform;

a cable spool sheave for windably receiving and securing a second end of the cable and a portion of a cable thereon, wherein cable is wound onto the spool to raise the moveable platform, wherein cable tension supports the platform at an elevation along the rails;

a cable pulley secured to the bottom of the elevated platform near the top end of the rails, wherein the cable routes from the cable spool, over the pulley, then down to secure to the back wall of the lift platform; and a gear reducer having an input shaft and an output shaft, the input shaft joined to the output shaft of the motor, the output shaft of the reducer joined to the cable spool sheave, wherein the motor rotates the sheave through the reducer;

at least one substantially upright hand hold bar having a lower portion secured to one flange of the lift platform, the hand hold for providing hand support to a person riding the lift platform;

an electrical drive motor control means, the control means operable by the hand of the person riding the lift platform, the control means having raise, lower and stop positions for commanding rotation of the motor driven means; and a power supply means for providing electric power to operate the motor drive means, said power supply means electrically connected to said control means and motor.

2. The personnel lift apparatus of claim 1, wherein:

the track of each rail comprises a cavity along length of the rail and a slot extending through a front face of the rail, the slot joining with the cavity, the cavity and slot providing a supportive and retentive guide track for a movable load bearing platform;

the roller bracket frame and roller wheels are rollably, moveably and retentively received into the cavity of the rail; and the elongated threaded bolts of the roller bracket extend outwards through the slot of the rail, and extending through the holes of the flanges of the movable lift platform.

3. The personnel lift apparatus of claim 2, wherein each rail is secured to opposing substantially upright legs of a ladder, wherein the personnel lift eliminates the need for a person to climb the ladder; and the electrically driven means is secured to the elevated platform member.

4. The personnel lift apparatus of claim 3, wherein the drive motor control means comprises an electrical rocker switch secured to one hand hold bar, the rocker switch positioned to be easily operated by the hand of the moveable platform rider, the rocker switch having raise, lower and stop positions, the rocker switch being spring loaded to automatically return to the stop position when released.

5. The personnel lift apparatus of claim 4, further comprising:

a safety strap having a first end secured to one of the hand hold bars;

a latching receptacle secured to another hand hold bar, the latching receptacle for receiving and latchably locking a second end of the safety strap into the receptacle, wherein the safety strap is restrainably operable to prevent the person riding the personnel lift from accidentally falling from the platform of the personnel lift.

6. The personnel lift apparatus of claim 5, wherein the electric drive motor comprises a 12 volt direct current motor; and wherein the power supply means comprises a 12 volt DC power supply such as commonly available on a motor vehicle, farm tractor or automotive storage battery.

7. The personnel lift apparatus of claim 5, wherein the electric drive motor comprises a 120 volt alternating current motor; and wherein the power supply means comprises a 120 volt alternating current power supply.

8. A personnel lift apparatus for raising or lowering a standing person between two or more elevations comprising:

two elongated upright substantially parallel distally spaced rails, each rail having a track along length of the rail, the rail providing a supportive and retentive guide track for a movable load bearing platform;

the movable load bearing lift platform for raising or lowering a person in a standing position on the personnel lift apparatus, the movable lift platform comprising:

a substantially horizontal platform floor sized for supportively receiving a standing person onto the platform floor;

a rigid back wall having a hole for receiving a cable clamp in a mid portion of the back wall, the back wall secured to a back edge of the platform floor, the wall substantially perpendicular to the platform floor, the back wall extending above the platform floor so as to guidably retain feet of the standing person on the platform;

a pair of sidewalls, each secured to opposing side edges of the platform floor, the sidewalls secured along a rear portion to opposing side edges of the rigid back wall, the sidewalls and back wall forming a rigid frame for structural support to the platform floor, the sidewalls guidably retaining the feet of the standing person on the platform floor; and a pair of flanges having two distally spaced holes therethrough, the holes positioned near opposing top and bottom portions of the flange, the flanges distally spaced across the platform, each flange uniquely secured to an outside face of the opposing sidewalls, wherein each sidewall has only one flange secured thereto;

a pair of roller bracket assemblies, each roller bracket assembly comprising:

an elongated roller bracket frame having two holes for receiving an axle and two holes for receiving an elongated threaded bolt therethrough, the axle holes proximate opposing end portions of the roller bracket frame, the axle holes extending through opposing sidewalls of the roller bracket frame, the bolt holes distally spaced along and extending through a top and bottom face of the roller bracket frame, the holes in each roller bracket positioned to align with the distally spaced holes in one flange;

two axles, each axle received into the axle hole, each axle sized to extend outwards beyond the sidewalls of the roller bracket frame;

two pairs of roller wheels, each roller wheel having a bearing for receiving the axle therethrough, each roller wheel rollably secured to opposing ends of the axle, wherein the roller bracket frame and roller wheels are rollably and moveably received onto the track of the rail; and a pair of elongated threaded bolts, each bolt received into the bolt holes of the flange, each bolt having a threaded portion extending outwards beyond the top face of the roller bracket, extending outwards beyond the front face of the rail and extending through the holes of the flanges and secured to the flanges, wherein the moveable load bearing platform is rollably, supportively and moveably secured to the rails by the roller bracket assemblies, wherein the load bearing platform is free to move along and guided by the track of the rails;

an electrically motor driven means of raising and lowering the movable platform, the motor driven means comprising:

a reversible electric drive motor having an output shaft;

a flexible metallic cable having two ends, a first end secured to the back wall of the lift platform;

a cable spool sheave for windably receiving and securing a second end of the cable and a portion of a cable thereon, wherein cable is wound onto the spool to raise the moveable platform, wherein cable tension supports the platform at an elevation along the rails;

a cable pulley secured to an upper portion of the rails, wherein the cable routes from the cable spooi, over the pulley, then down to secure to the back wall of the lift platform; and a gear reducer having an input shaft and an output shaft, the input shaft joined to the output shaft of the motor, the output shaft of the reducer joined to the cable spool sheave, wherein the motor rotates the sheave through the reducer;

at least one substantially upright hand hold bar having a lower portion secured to one flange of the lift platform, the hand hold for providing hand support to a person riding the lift platform;

an electrical drive motor control means, the control means operable by the hand of the person riding the lift platform, the control means having raise, lower and stop positions for commanding rotation of the motor driven means; and a power supply means for providing electric power to operate the motor drive means, said power supply means electrically connected to said control means and motor.

9. The personnel lift apparatus of claim 8, wherein:

the track of each rail comprises a cavity along length of the rail and a slot extending through a front face of the rail, the slot joining with the cavity, the cavity and slot providing a supportive and retentive guide track for a movable load bearing platform;

the roller bracket frame and roller wheels are rollably, moveably and retentively received into the cavity of the rail; and the elongated threaded bolts of the roller bracket extend outwards through the slot of the rail, and extending through the holes of the flanges of the movable lift platform.

10. The personnel lift apparatus of claim 9, wherein the electrically driven means is secured to a lower portion of the rails of the lift apparatus.

11. The personnel lift apparatus of claim 10, wherein the drive motor control means comprises an electrical rocker switch secured to one hand hold bar, the rocker switch positioned to be easily operated by the hand of the moveable platform rider, the rocker switch having raise, lower and stop positions, the rocker switch being spring loaded to automatically return to the stop position when released.

12. The personnel lift apparatus of claim 11, further comprising:

a safety strap having a first end secured to one of the hand hold bars;

a latching receptacle secured to another hand hold bar, the latching receptacle for receiving and latchably locking a second end of the safety strap into the receptacle, wherein the safety strap is restrainably operable to prevent the person riding the personnel lift from accidentally falling from the platform of the personnel lift.

13. The personnel lift apparatus of claim 12, wherein the electric drive motor comprises a 12 volt direct current motor; and wherein the power supply means comprises a 12 volt DC storage battery.

14. Thepersonnel lift apparatus of claim 12, wherein the electric drive motor comprises a 120 volt alternating current motor; and wherein the power supply means comprises a 120 volt alternating current power supply.

* * * * *